US008602101B2

(12) United States Patent
Gibson et al.

(10) Patent No.: US 8,602,101 B2
(45) Date of Patent: Dec. 10, 2013

(54) MULTI-CYCLE PIPE CUTTER AND RELATED METHODS

(75) Inventors: Kenneth Gibson, Portlethen (GB); Stephen Hekelaar, Aberdeen (GB)

(73) Assignee: Smith International, Inc., Houston, TX (US)

( * ) Notice: Subject to any disclaimer, the term of this patent is extended or adjusted under 35 U.S.C. 154(b) by 255 days.

(21) Appl. No.: 13/011,492

(22) Filed: Jan. 21, 2011

(65) Prior Publication Data

US 2012/0186817 A1 Jul. 26, 2012

(51) Int. Cl.
*E21B 29/00* (2006.01)

(52) U.S. Cl.
USPC ..... 166/298; 166/55.7

(58) Field of Classification Search
USPC ..... 166/297, 298, 55.7, 55.8
See application file for complete search history.

(56) References Cited

U.S. PATENT DOCUMENTS 2,735,485 A * 2/1956 Metcalf, Jr. ..... 166/55.8
2,822,150 A * 2/1958 Muse et al. ..... 175/266
2,899,000 A * 8/1959 Medders et al. ..... 166/55.8
4,491,187 A 1/1985 Russell
5,018,580 A 5/1991 Skipper
5,074,355 A 12/1991 Lennon
5,265,675 A * 11/1993 Hearn et al. ..... 166/297
5,732,770 A 3/1998 Beeman
7,823,663 B2 * 11/2010 Eddison ..... 175/269
2009/0321065 A1 * 12/2009 Vinson et al. ..... 166/101

OTHER PUBLICATIONS

International Search Report & Written Opinion issued in corresponding International Application No. PCT/US2012/021871; Dated Aug. 9, 2012 (9 pages).

* cited by examiner

*Primary Examiner* — William P Neuder
(74) *Attorney, Agent, or Firm* — Osha Liang LLP

(57) ABSTRACT

A downhole pipe cutting tool includes a tool body having a piston assembly disposed in a central bore thereof, wherein the piston assembly is configured to translate longitudinally along the central axis of the tool body, and a plurality of cutter knife sets. Each of the plurality of cutter knife sets includes at least two individual cutter knives circumferentially spaced about a central axis of the tool body and is configured to selectively engage with the piston assembly to extend outward to perform pipe cutting operation.

22 Claims, 6 Drawing Sheets

MULTI-CYCLE PIPE CUTTER AND RELATED METHODS

FIELD OF THE INVENTION

Embodiments disclosed herein relate generally to apparatus and methods for cutting casing in a wellbore. More specifically, embodiments disclosed herein relate to apparatus and methods for making multiple casing cuts downhole in a wellbore in a single trip.

BACKGROUND ART

In oil and gas exploration and development operations it may be desirable to remove casing that has previously been set in the wellbore. In the drilling of oil and gas wells, concentric casing strings are installed and cemented in the borehole as drilling progresses to increasing depths. Each new casing string is supported within the previously installed casing string, thereby limiting the annular area available for the cementing operation. Casing removal involves severing a section of the casing string and pulling the free end to the surface to remove the severed section. Typically, a downhole tool having cutters thereon may be run into the casing multiple times to cut and extract sections of casing until complete. For instance, a cutting device may first be lowered into the wellbore to cut the casing at a desired depth, after which the cutting device is returned to the surface. Subsequently, a spearing device may then be lowered downhole to engage a free end of the severed casing. Once the free end of the casing is engaged the section of severed casing may be pulled from the wellbore.

In certain situations, difficulties may arise in which the severed casing is unable to be pulled from the wellbore, for example, the casing was not severed adequately at a certain location. In this case, the spearing device is removed, the cutting device reinserted in the wellbore, and a second cut may be made in the casing string at a second location in another attempt to sever the section of casing. Attempts to remove the casing with the spearing device may again be commenced and this process repeated until the section of casing is successfully severed and removed. Depending on the number of cuts required to sever the casing, multiple trips into the wellbore may be required before the casing is severed and removed. Thus, overall time and costs involved in completing a casing extraction may be greatly increased.

Accordingly, there exists a need for apparatus and methods capable of reducing the number of trips required into the wellbore to sever and remove casing.

SUMMARY OF THE DISCLOSURE

In one aspect, embodiments disclosed herein relate to a downhole pipe cutting tool including a tool body having a piston assembly disposed in a central bore thereof, wherein the piston assembly is configured to translate longitudinally along the central axis of the tool body, and a plurality of cutter knife sets. Each of the plurality of cutter knife sets includes at least two individual cutter knives circumferentially spaced about a central axis of the tool body and is configured to selectively engage with the piston assembly to extend outward to perform pipe cutting operation.

In other aspects, embodiments disclosed herein relate to a method of making multiple cuts in a wellbore casing, the method including running a downhole pipe cutting tool into a wellbore, shifting a piston assembly disposed within a central bore of the downhole pipe cutting tool, engaging blade activating lobes on the pressure activated piston with a first set of cutter knives, deploying the first set of cutter knives to an extended position and engaging the extended cutter knives with the wellbore casing, and rotating the downhole pipe cutting tool and cutting the wellbore casing.

Other aspects and advantages of the invention will be apparent from the following description and the appended claims.

DETAILED DESCRIPTION

Figure 1:
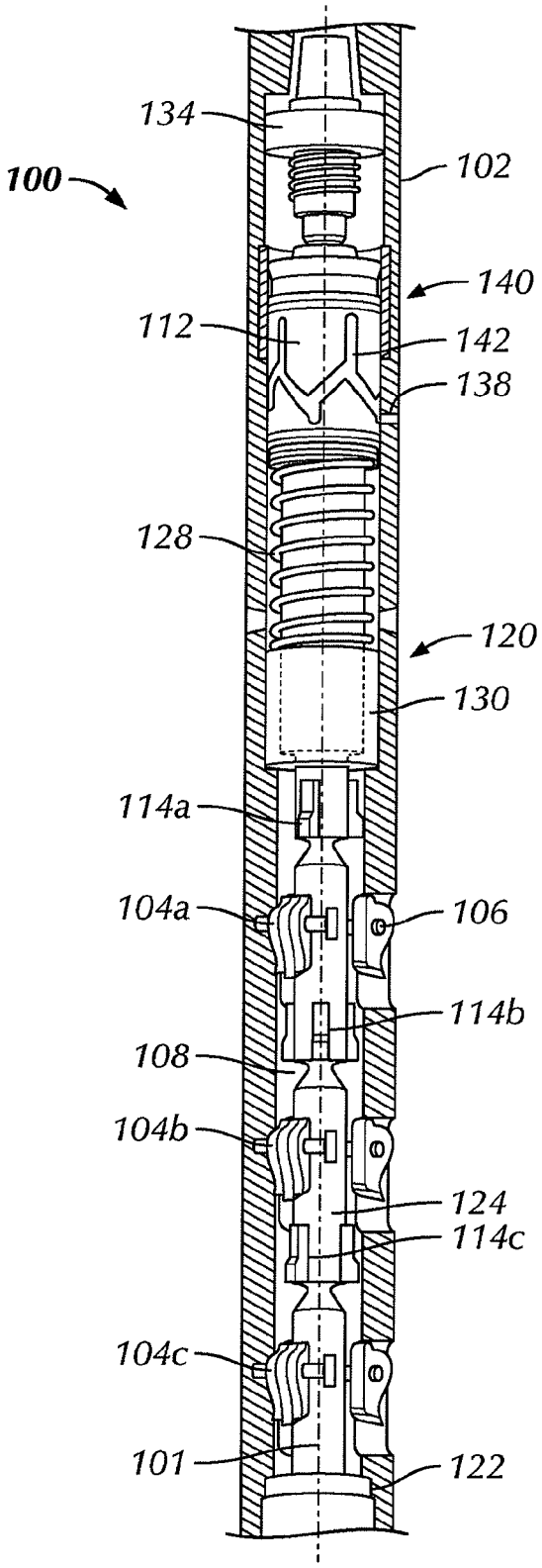
FIG. 1 shows a cross-section view of a multi-cycle downhole cutting tool in accordance with one or more embodiments of the present disclosure.

Embodiments disclosed herein relate to a multi-cycle downhole cutting tool capable of severing a casing at one or more locations in a single trip into a wellbore. Referring initially to FIG. 1, a cross-section view of a downhole cutting tool 100 in accordance with one or more embodiments of the present disclosure is shown. The downhole cutting tool 100 may be attached to a distal end of a drillstring (not shown) and disposed within a wellbore and may be configured to make multiple cuts in a casing installed in the wellbore.

The multi-cycle downhole cutting tool 100 includes a tool body 102 having a central bore 108 therethrough and having one or more cutter knife sets 104*a*, 104*b*, 104*c* mounted thereon. Each cutter knife set 104*a*, 104*b*, 104*c* may include one or more individual cutter knives arranged circumferentially about a central axis 101 of the tool body 102. Each individual cutter knife may be pivotably mounted in the wall of the tool body 102, for example by means of a knife hinge pin 106, which allows the individual cutter knife to pivot between a retracted position and an extended position. As used herein, retracted position may be characterized as the position of a cutter knife that has been rotated inward so as to be flush with the tool body (as shown in FIG. 1). Extended position may be characterized as the position of a cutter knife that has been rotated away and extended from the tool body such that a cutting edge of the cutter knife contacts the casing (not shown).

The tool 100 may further include a pressure activated piston assembly 120 disposed within the central bore 108 of the tool body 102, supported at a lower end by a bushing 122 which is configured to center the piston assembly 120 within the central bore 108. The pressure activated piston assembly

120 may be configured to translate longitudinally within the tool body 102 along the central axis 101 in response to an applied fluid pressure provided by, for example, a pump (not shown). The piston assembly 120 includes a piston head 112 and a mandrel 124 extending longitudinally therefrom, the mandrel 124 having a plurality of blade activating lobes 114*a*, 114*b*, 114*c* disposed on an outer surface thereof. The blade activating lobes may be integrally formed with, or attached on the outer surface of the mandrel 124 and may be configured to engage with the corresponding plurality of knife sets 104*a*, 104*b*, 104*c* during longitudinal translation of the piston assembly 120 within the bore 108 to extend the cutter knives.

The piston assembly 120 further includes a spring 128, or other biasing mechanism, disposed about the piston head 112 and a piston stop 130 configured to limit the longitudinal movement of the piston assembly 120 within the central bore 108. Furthermore, the piston assembly 120 may have a central bore (not shown) therethrough which allows for fluid to travel through for fluid communication with additional downhole tools. A pressure drop indicator 134 is also disposed within central bore 108 and is positioned uphole, and in fluid communication with, piston assembly 120. Pressure drop indicator 134 is configured to confirm completion of each casing cut by indicating a pressure drop to an operator when the casing is severed by the cutter knives. In certain embodiments, the pressure drop indicator may include a stationary stinger (not shown) disposed within a bore of piston assembly 120 at the top. An axial length of the stinger may be equal to the axial stroke (required to complete the cut) of the piston assembly 120. A diameter of the stinger may be less than the piston assembly bore diameter. Initially, the stinger stays in the bore creating restricted flow area and thereby requiring higher activation pressure. When the cut is complete, the piston assembly 120 moves downward equal to the stroke thereby clearing the stinger from the bore and removing the flow restriction resulting in drop of the activation pressure. The pressure drop may be in the range of 200-300 psi, which is noticeable on the rig floor. Other devices such as pressure sensors may also be used in conjunction with pulse telemetry or with hard wired connection. In other embodiments, pressure sensors may be used.

Figure 2A:
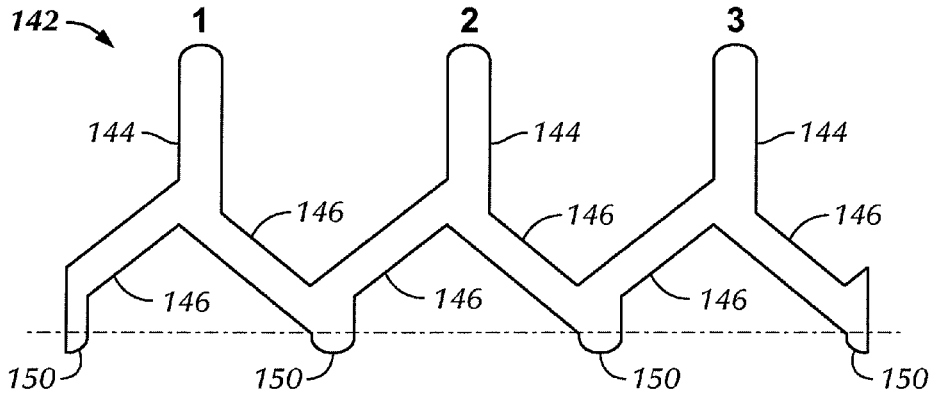
FIGS. 2A and 2B show plan views of an indexing track in accordance with one or more embodiments of the present disclosure.
Figure 2B:
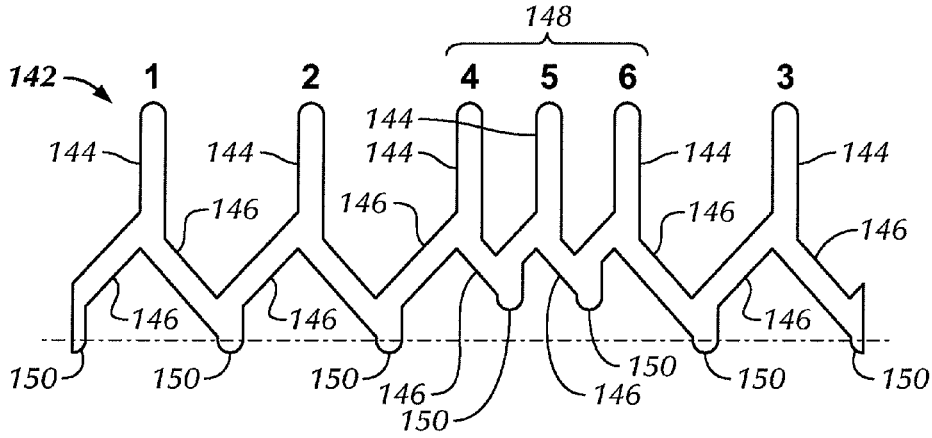
Figure 3A:
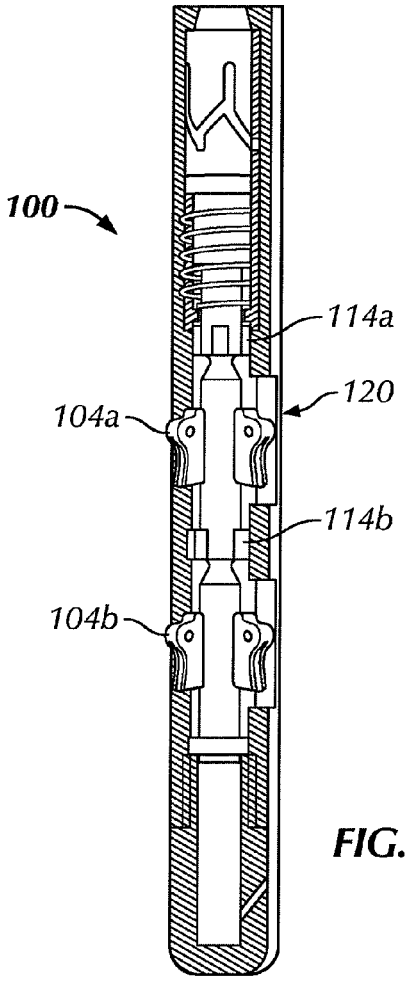
FIGS. 3A and 3B show a cross-section and plan view, respectively, of the multi-cycle downhole cutting tool with cutters disengaged in accordance with one or more embodiments of the present disclosure.
Figure 3B:
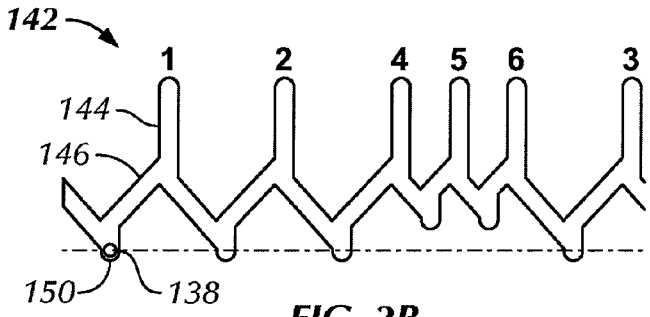

The downhole cutting tool 100 further includes an indexing mechanism 140 disposed at an upper end of the piston assembly 120 and configured to dictate selective engagement between the plurality of blade activating lobes 114*a*, 114*b*, 114*c* and the plurality of cutter knife sets 104*a*, 104*b*, 104*c*. The indexing mechanism 140 includes a circumferential indexing track 142 in which a fixed travel pin 138 is configured to engage. Thus, the engagement of travel pin 138 with indexing track 142 in combination with fluctuations in fluid pressure, results in a predetermined longitudinal and angular motion of the piston assembly 120 relative to tool body 102. FIGS. 2A and 2B show plan views of the indexing track 142 in accordance with one or more embodiments of the present disclosure. As shown in FIG. 2A, indexing track 142 may include multiple track sections configured to manipulate the piston assembly 120 (FIG. 1) into various movements, namely longitudinal track sections 144 and angular track sections 146.

Longitudinal track sections 144 may be arranged circumferentially such that engagement of the travel pin 138 (FIG. 1) with longitudinal track sections 144 is configured to align blade activating lobes (114*a*, 114*b*, 114*c* shown in FIG. 1) with one of the cutter knife sets (104*a*, 104*b*, 104*c* shown in FIG. 1) to be extended. For example, engagement of travel pin 138 within longitudinal track section 144 indicated at "1" and movement therein may cause blade activating lobe 114*a* (FIG. 1) to align with and engage cutter knife set 104*a* (FIG. 1) to extend the cutter knife set. Similarly, engagement of travel pin 138 within longitudinal track section 144 indicated at "2" and movement therein may cause blade activating lobe 114*b* to align with and engage cutter knife set 104*b* to extend the cutter knife set. Still further, engagement of travel pin 138 within longitudinal track section 144 indicated at "3" and movement therein may cause blade activating lobe 114*c* to align with and engage cutter knife set 104*c* to extend the cutter knife set. However, those skilled in the art will appreciate that alternative timing arrangements between longitudinal tracks and cutter knife sets are possible.

Further, indexing track 142 may have angular track sections 146 disposed between the longitudinal track sections 144 and configured to manipulate the piston assembly 120 in simultaneous longitudinal translation and rotation. Thus, engagement of travel pin 138 within angular track sections 146 may cause piston assembly 120 to rotate and translate longitudinally within the tool body as the piston assembly 120 moves between engagement of the multiple cutter knife sets 104*a*, 104*b*, 104*c*. Further, during engagement of the travel pin 138 within angular track sections 146, the blade activating lobes 114*a*, 114*b*, 114*c*, may be misaligned with the cutter knife sets 104*a*, 104*b*, 104*c* such that cutters are retracted.

As shown in FIG. 2B, in certain embodiments, an additional track section 148 may be juxtaposed within the indexing track 142 for timing purposes. The additional track section 148 also includes longitudinal track sections 144 and angular track sections 146; however, circumferential spacing between the longitudinal track sections 144 may be reduced as compared to the spacing of track sections indicated at 1, 2, and 3. In essence, the additional track section 148 may be characterized as a auxiliary track section because no alignment of blade activating lobes/cutter knife sets occurs as the pin 138 travels through the auxiliary track section. Instead, longitudinal and rotational movement of the piston assembly 120 is shortened as the pin 138 travels through the auxiliary track section to return the piston assembly 120 to its proper timing with functional track sections (i.e., track sections indicated at 1, 2, and 3). Furthermore, although three longitudinal track sections are shown in FIG. 2A, alternative embodiments may include additional longitudinal track sections which correspond to additional cutter knife sets. In certain embodiments, indexing track 142 may include transition slots 150 configured to direct the one-way rotational movement of the piston assembly 120 during cycling of the fluid pressure. It will be understood that indexing tracks may be configured to allow for two-way rotational motion, for example, by eliminating lower transition slots 150.

Methods of making multiple casing cuts in a single downhole trip using the multi-cycle downhole cutting tool in accordance with one or more embodiments of the present disclosure are described in reference to FIGS. 3A-6B. Initially, referring to FIGS. 3A and 3B, the downhole pipe cutting tool 100 may be attached to a drill string (not shown) and lowered to an initial depth where the casing is to be cut. In the initial configuration, low or no pressure may be applied to pressure activated piston assembly 120, which may allow the cutter knives 104*a*, 104*b* to remain in a retracted position, as shown. Further, referring to FIG. 3B, travel pin 138 may be initially located in a transition slot 150 (as shown) or an angular track section 146 of indexing track 142 where the cutter knives 104*a*, 104*b* are retracted.

Figure 4A:
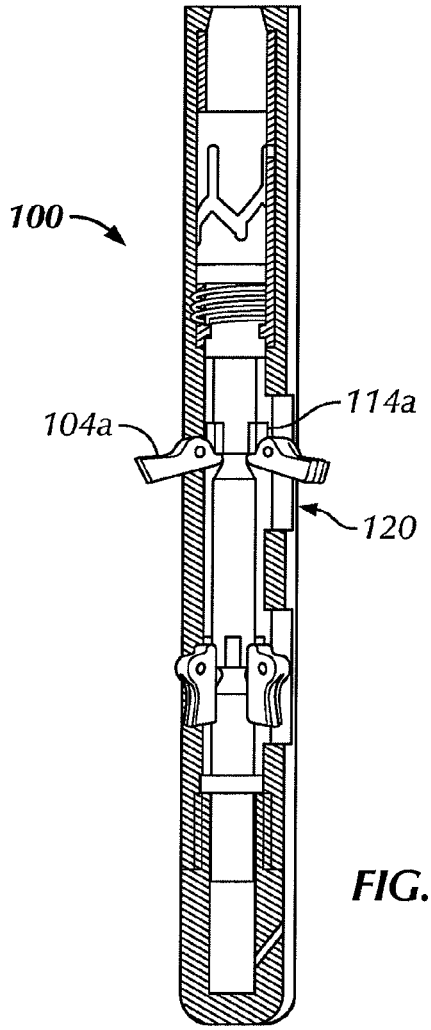
FIGS. 4A and 4B show a cross-section and plan view, respectively, of the multi-cycle downhole cutting tool with a first set of cutters engaged in accordance with one or more embodiments of the present disclosure.
Figure 4B:
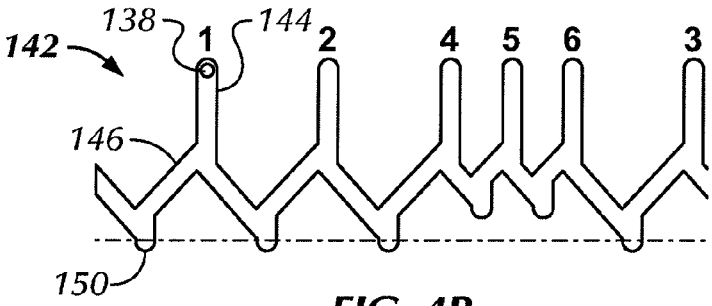

Referring now to FIGS. 4A and 4B, methods of activating a first set of cutter knives 104*a* to an extended position are described in accordance with one or more embodiments of the present disclosure. Fluid pressure acting on pressure activated piston assembly 120 may be increased to move piston assembly 120 longitudinally downward, which also incurs a rotation of pressure activated piston assembly 120 due to engagement between travel pin 138 and angular track section 146. As such, pressure activated piston assembly 120 may be rotated to a position in which blade activating lobe set 114*a* is aligned with and engages a corresponding set of cutter knives 104*a*, resulting in the set of cutter knives 104*a* being deployed to an extended position. Further, as shown in FIG. 4B, cutter knives 104*a* may be fully deployed when travel pin 138 is located at an upper end of the longitudinal track section 144 indicated by position "1."

Figure 5A:
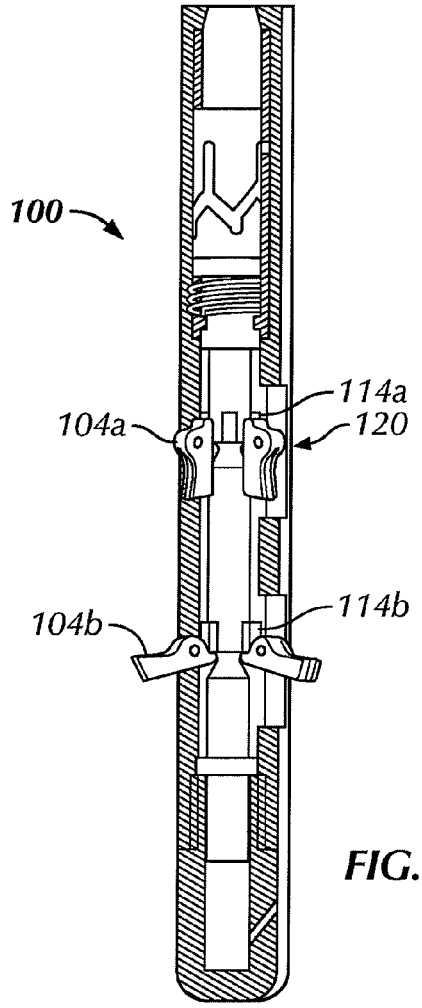
FIGS. 5A and 5B show a cross-section and plan view, respectively, of the multi-cycle downhole cutting tool with a second set of cutters engaged in accordance with one or more embodiments of the present disclosure.
Figure 5B:
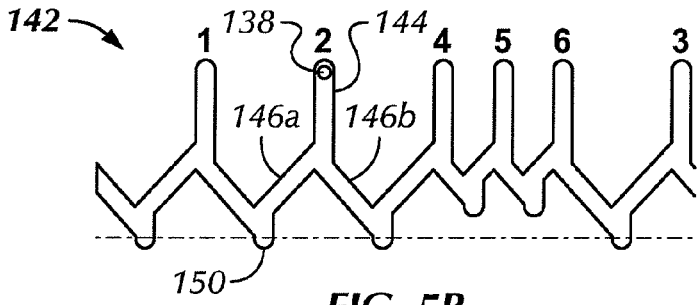

Referring now to FIGS. 5A-5B, methods of activating a second set of cutter knives 104*b* to an extended position are described in accordance with one or more embodiments of the present disclosure. With travel pin 138 starting in the longitudinal track section 144 indicated by position "1," fluid pressure acting on pressure activated piston assembly 120 may be decreased to allow piston assembly 120 to move longitudinally upward (biased by spring mechanism 128 in FIG. 1), which also incurs a rotation of pressure activated piston assembly 120 due to engagement between travel pin 138 and angular track section 146A. Cutter knives 104*a* and blade activating lobes 104*b* are disengaged and cutter knives 104*a* are retracted.

Fluid pressure acting on pressure activated piston assembly 120 is again increased to move piston assembly 120 longitudinally downward, which further rotates piston assembly 120 due to engagement between travel pin 138 and angular track section 146B. As such, pressure activated piston assembly 120 may be rotated to a position in which blade activating lobe set 114*b* is aligned with and engages a corresponding set of cutter knives 104*b*, resulting in the set of cutter knives 104*b* being deployed to an extended position. Cutter knives 104*b* are fully deployed when travel pin 138 is located at an upper end of the longitudinal track section 144 indicated by position "2," as shown in FIG. 5B.

Figure 6A:
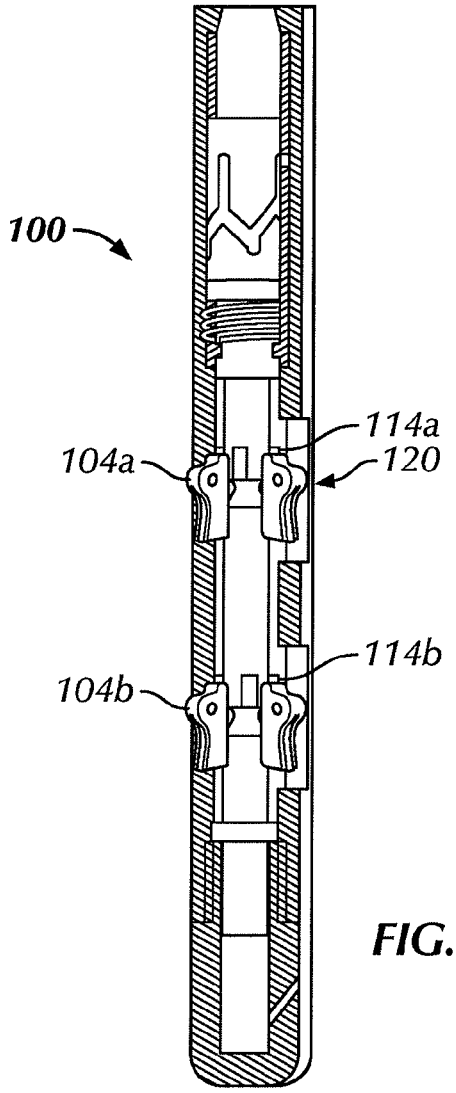
FIGS. 6A and 6B show a cross-section and plan view, respectively, of the multi-cycle downhole cutting tool with cutters disengaged in accordance with one or more embodiments of the present disclosure.
Figure 6B:
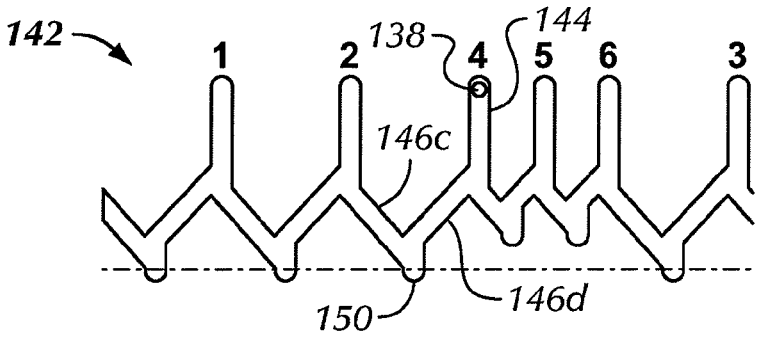

Referring now to FIGS. 6A-6B, methods of pressurizing pressure activated piston assembly 120 without activating any sets of cutter knives are described in accordance with one or more embodiments of the present disclosure. With travel pin 138 starting in the longitudinal track section 144 indicated by position "2," fluid pressure acting on piston assembly 120 is decreased to allow piston assembly 120 to move longitudinally upward, which again incurs a rotation of pressure activated piston assembly 120 due to engagement between travel pin 138 and angular track section 146*c*. Subsequently, fluid pressure acting is again increased to move piston assembly 120 back longitudinally downward and rotating the piston 120 due to engagement between travel pin 138 and angular track section 146*d*. As such, pressure activated piston assembly 120 may be rotated to a position in which the blade activating lobe sets 114*a* or 114*b* are not aligned with any corresponding sets of cutter knives 104*a* or 104*b*, respectively. In this case, travel pin 138 may be located at an upper end of the longitudinal track section 144 indicated by position "4," as shown in FIG. 6B. The pin 138 may continue to travel through track sections 4, 5, and 6 without deploying cutter knives.

Methods of making multiple cuts in the casing with the multi-cycle downhole cutting tool as described above may proceed as follows. With the set of cutter knives 104*a* in an extended position (shown in FIG. 4A), a first cut in the casing may be made by rotating the tool in the wellbore, for example, by rotating the drillstring to which the upper end of the tool is attached. In certain embodiments, completion of the cut may be verified by a pressure drop indicator (not shown) disposed within the cutting tool that registers the corresponding fluid pressure drop when the wall of the casing has been severed. After the first cut is completed, an attempt may be made to remove the first cut section of the casing from the wellbore. For example, removal attempts may be made by activating any type of downhole tool (not shown) capable of engaging a casing, for example, a spearing or grappling tool, and pulling upward on the casing. If the casing has been adequately severed by the first cut, the severed casing section may then be removed by withdrawing the drillstring from the wellbore. In addition, other devices typically used during a casing removal process may be engaged, for example, a jarring device may also be used during the removal process to help free the cut casing segment.

If the first cut section of the casing is unable to be removed for any reason, or if a second cut is desired, a second cut may be attempted at the same or a different location along the casing using the same or a different set of cutter knives. Before the second cut attempt, the drillstring may be raised or lowed in the wellbore if it is desired to make the second cut at a new location along the casing. Furthermore, if it is determined that a different set of cutter knives should be used, for example, cutter knives 104*b* (shown in FIGS. 5A and 5B), the fluid pressure to the pressure activated piston head 112 may be cycled (e.g., off and on) such that the second blade activating lobe set 114*b* engages with the corresponding second set of cutter knives 104*b*, resulting in the second set of cutter knives 104*b* being deployed to an extended position. A second cut is then made in the casing using the second set of cutter knives 104*b* in a manner similar to that described above for the first casing cut. Subsequently, another attempt at removal of the casing is made.

Furthermore, another downhole tool that is attached to the cutting tool 100 may be operated by moving the piston assembly 120 from the configuration shown in FIG. 5A to the auxiliary configuration shown in FIG. 6A. In this example, the pressure is cycled once to move from the longitudinal track section 144 indicated by position "2" in FIG. 5B to the auxiliary longitudinal track section indicated by position "4" in FIG. 6B. In this configuration, pressure may be applied to another tool through the fluid communication allowed by a central bore (not shown).

The above steps may be repeated numerous times to make any number of cuts, as required by the casing removal operation. One of ordinary skill in the art will appreciate that, depending on the cutting operation, the number of cutter knives per set, the number of cutter knife sets, and even the number of downhole cutting tools disposed in the wellbore may vary. As such, in certain embodiments, the multi-cycle cutting tool may include more or less than three cutter knife sets, with each cutter knife set including any number of individual cutters. One of ordinary skill in the art will recognize that the order in which the cutter knife sets are deployed may be varied (i.e., cutter set 104*b* deployed first followed by cutter knife set 104*a*). In addition, according to one or more embodiments of the present disclosure, the pressure activated piston assembly may be cycled to a position where no cutter knife sets are engaged. In this configuration, another tool may be activated without activating any of the cutter knife sets.

Advantageously, embodiments disclosed herein provide a multi-cycle downhole pipe cutting tool that may be used to make multiple cuts in a single casing with only a single downhole trip of the tool. Thus, overall time and costs involved in completing a casing extraction may be greatly reduced.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A downhole pipe cutting tool comprising:

a tool body having a piston assembly disposed in a central bore thereof, the piston assembly having an indexing track configured to engage with a fixed pin secured to the tool body and the piston assembly is configured to translate longitudinally along a central axis of the tool body; and a plurality of cutter knife sets, each of the plurality of cutter knife sets including at least two individual cutter knives circumferentially spaced about the central axis of the tool body, and each of the plurality of cutter knife sets configured to selectively engage with the piston assembly to extend outward to perform a pipe cutting operation.

2. The downhole pipe cutting tool of claim 1, the indexing track comprising:

longitudinal track sections disposed in the piston assembly;

angular track sections disposed between the longitudinal track sections; and transition slots, wherein engagement of the fixed pin and the longitudinal track sections is configured to selectively engage at least one of the plurality of cutter knife sets.

3. The downhole pipe cutting tool of claim 2, wherein engagement of the fixed pin and the angular track sections is configured to selectively disengage at least one of the plurality of cutter knife sets.

4. The downhole pipe cutting tool of claim 2, further comprising an auxiliary track section, wherein engagement of the fixed pin and the auxiliary track section is configured to selectively disengage all of the plurality of cutter knife sets.

5. The downhole pipe cutting tool of claim 4, further comprising another downhole tool included in the drill string configured to operate when the fixed pin is engaged with the auxiliary track section.

6. The downhole pipe cutting tool of claim 1, wherein the indexing track is configured to rotate the piston in a one-way direction.

7. The downhole pipe cutting tool of claim 1, wherein engagement of the indexing track with the fixed pin secured to the tool body is configured to translate and rotate the piston assembly.

8. The downhole pipe cutting tool of claim 1, further comprising blade activating lobes disposed along a length of the piston assembly and configured to correspond with the plurality of cutter knife sets.

9. The downhole pipe cutting tool of claim 8, wherein translation and rotation of the piston assembly is configured to selectively engage at least one of the individual cutter knives with at least one corresponding blade activating lobe.

10. The downhole pipe cutting tool of claim 8, further comprising a piston stop disposed in the central bore of the tool body and configured to restrict longitudinal movement of the piston assembly when the blade activating lobes do not engage the plurality of cutter knife sets.

11. The downhole pipe cutting tool of claim 1, further comprising a pressure drop indicator configured to indicate when a cut has been completed in a casing.

12. The downhole pipe cutting tool of claim 1, further comprising a piston return spring disposed in the central bore of the tool body, wherein the piston return spring is configured to bias the pressure activated piston assembly in an upward direction against a downward fluid pressure.

13. The downhole pipe cutting tool of claim 1, wherein the at least two individual cutter knives are mounted pivotably in a wall of the tool body.

14. A method of making multiple cuts in a wellbore casing, the method comprising:

running a downhole pipe cutting tool into a wellbore;

shifting a piston assembly disposed within a central bore of the downhole pipe cutting tool;

engaging a first set of blade activating lobes on the piston assembly with a first set of cutter knives, the engaging including aligning the first set of blade activating lobes with the first set of cutter knives using an indexing track located on the piston assembly;

deploying the first set of cutter knives to an extended position and engaging the extended first set of cutter knives with the wellbore casing; and rotating the downhole pipe cutting tool and cutting the wellbore casing.

15. The method of claim 14, further comprising:

applying a fluid pressure on the piston assembly and further shifting the piston assembly;

engaging a second set of blade activating lobes with a second set of cutter knives;

deploying the second set of cutter knives to an extended position and engaging the extended second set of cutter knives with the wellbore casing; and rotating the downhole pipe cutting tool and cutting the wellbore casing.

16. The method of claim 15, further comprising cutting the wellbore casing with the first set of cutter knives and the second set of cutter knives in a single trip into the wellbore.

17. The method of claim 15, further comprising repositioning the downhole cutting tool prior to deploying the second set of cutter knives.

18. The method of claim 15, further comprising dictating a selective engagement between the first set of blade activating lobes and the first set of cutter knives and a selective engagement between the second set of blade activating lobes and the second set of cutter knives with the indexing track located on the piston assembly.

19. The method of claim 14, further comprising indicating a pressure drop to an operator when the wellbore casing is fully severed.

20. The method of claim 14, further comprising rotating the piston assembly in a one-way direction.

21. The method of claim 14, further comprising fluctuating a fluid pressure to rotate and translate the piston assembly within the central bore of the tool body.

22. The method of claim 14, further comprising activating additional downhole tools included in the drillstring while selectively disengaging all cutter knives.

* * * * *